US006074332A

United States Patent [19]

Helmstädter et al.

[11] Patent Number: 6,074,332

[45] Date of Patent: Jun. 13, 2000

[54] KNIFE FOLDER

[75] Inventors: Maximilian Helmstädter, Villingen-Schwenningen; Karlheinz Weinmann, Utting, both of Germany

[73] Assignee: Böwe Systec AG, Augsburg, Germany

[21] Appl. No.: 09/066,439

[22] PCT Filed: Feb. 21, 1997

[86] PCT No.: PCT/EP97/00851

§ 371 Date: Apr. 27, 1998

§ 102(e) Date: Apr. 27, 1998

[87] PCT Pub. No.: WO97/30925

PCT Pub. Date: Aug. 28, 1997

[30] Foreign Application Priority Data

Feb. 23, 1996 [DE] Germany ..... 196 06 821

[51] Int. Cl.[7] ..... B31B 21/26; B31B 23/26

[52] U.S. Cl. ..... 493/254; 493/437; 493/444; 493/445

[58] Field of Search ..... 493/231, 243, 493/242, 250, 251, 252, 254, 405, 437, 444, 445

[56] References Cited

U.S. PATENT DOCUMENTS

| | | | |
|---|---|---|---|
| 3,926,425 | 12/1975 | Pierce et al. | 493/444 |
| 3,995,850 | 12/1976 | Hertrich et al. | 493/444 |
| 4,338,088 | 7/1982 | Buss et al. | 493/445 |
| 4,493,690 | 1/1985 | Niemiro et al. | 493/445 |
| 5,085,625 | 2/1992 | Kojima | 493/444 |

FOREIGN PATENT DOCUMENTS

| | | | |
|---|---|---|---|
| 2 461 671 | 2/1981 | France | B65H 45/18 |
| 228894 | 3/1909 | Germany . | |
| 2146013 | 3/1973 | Germany | B65H 45/22 |
| 41 01 399 A1 | 7/1992 | Germany | B65H 45/12 |

*Primary Examiner*—Eugene Kim
*Attorney, Agent, or Firm*—Duft, Graziano & Forest, P.C.

[57] ABSTRACT

A knife folder for folding a sheet material comprises a sheet-material feeder for feeding the sheet material in a first direction, a folder for folding said sheet material, and a sheet-material conveyer used for conveying the sheet material and comprising at least one pair of rotating conveying components whose axes of rotation are arranged in a second direction substantially at right angles to the first direction. The folder pushes the folded sheet material between the conveying components of the at least one pair of conveying components when it is at its folding position. The sheet material is advanced up to a stop. The folder comprises a knife extending in a third direction substantially at right angles to said first and said second direction. The sheet material can be conveyed in the third direction by actuating the conveying components.

10 Claims, 3 Drawing Sheets

KNIFE FOLDER

FIELD OF THE INVENTION

The present invention refers to paper processing devices in general and in particular to a knife folder for folding a sheet material that can, for example, be printed paper.

DESCRIPTION OF PRIOR ART

Knife folders are known from the field of technology. In such knife folders a sheet feed belt is arranged e.g. horizontally. In side-by-side relation with the sheet feed belt, a pair of rollers is arranged in such a way that the axes of rotation of both rollers are located in one plane which extends parallel to the surface of the sheet feed belt. The distance of the plane in which the axes of rotation of the pair of rollers are located is chosen such that a sheet material transported by the sheet feed belt is pushed from the sheet feed belt evenly over the pair of rollers. Normally, a folding knife is located centrally above the pair of rollers; said folding knife is secured to a lever and it is adapted to be moved cyclically to a folding position by means of said lever and a cam disc arrangement. When the folding knife occupies the folding position, a folding edge, which is formed at the lower end of said folding knife, is oriented such that a small distance exists between the plane defined by the axes of rotation of the pair of rollers and the folding edge of the folding knife. In addition, the folding edge is essentially at the same distance from both axes of rotation. On the side located opposite the sheet feed belt relative to the pair of rollers, a horizontally displaceable stop for the sheet material is provided.

In a known knife folder of this kind, the sheet feed belt transports the sheet material into the folding area. The horizontal movement of the sheet material is limited by the stop for the sheet material, the position of the stop determining the position of the fold on the sheet material. When the sheet material has reached the folding position, the folding knife is moved towards the sheet material substantially at right angles thereto. The folding edge of the folding knife comes into contact with the sheet material and presses the contact area, which exists between said sheet material and said folding edge and which is substantially linear, between the pair of rollers. This has the effect that areas of the sheet material which are separated by the contact area are raised relative to said contact area. The contact area of the sheet material and of the folding edge now approaches the plane defined by the axes of rotation of the two rollers of the pair of rollers.

The combined effect of the two rollers, one of said rollers being a driven transport roller and the other an idling counterpressure roller, has the effect that, as soon as the two rollers take hold of the sheet material in the contact area, they advance said sheet material in the direction predetermined by the direction of movement of the folding knife into the folding position. The engagement between the pair of rollers and the sheet material causes the sheet material to be folded at the point of the contact area due to the pressure which the pressing roller applies to the transport roller.

The folding effect existing due to the combined effect of the transport roller and of the pressing roller takes place essentially only at the moment at which the contact area of the sheet material and of the folding knife is located precisely in the plane defined by the axes of rotation. In view of the elasticity of the sheet material, the paper fold is hardly improved still further when the contact area of the sheet material and of the folding knife is located below the plane defined by the axes of rotation of the pair of rollers and when the sheet-material areas bordering on said contact area run through said pair of rollers.

When the sheet material has passed the pair of rollers completely, its direction of movement must be changed by a rerouting means so as to move said sheet material back into the plane of a paper processing line comprising the sheet feed belt and the knife folder as component parts.

For further processing by the paper processing line, it may be important which side of the sheet material printed e.g. on one side thereof rests on a sheet-material conveyor belt and which side faces away from said sheet-material conveyor belt. If the folded sheet material is inserted e.g. in envelopes or the like, the sheet material must first be introduced in the envelope such that the address is directed downwards, whereupon, after closing of the envelope, said envelope will have to be turned e.g. for subsequent franking. There are, however, also cases of use where the sheet material must have an inverse orientation after folding. In known knife folders the position of the folded sheet material in the paper processing line after the knife folder is determined by the rerouting device and the general conveying direction of the paper processing line, unless a further device is provided for a necessary turning of the sheet material; such a further device would, however, increase the investment and the costs.

DE-A1-2 146 013 discloses a means for longitudinally foldig sheets of paper. A sheet of paper is supplied to a rotating folding knife in a first direction with the aid of a paper feed means, the main surfaces of said folding knife extending also parallel to the first direction and at right angles to the plane defined by the sheet material supplied. A sheet that has been prefolded by the combined effect of the folding knife and an annular groove in a prefolding cylinder is pushed between two spherical rollers whose axis of rotation is arranged in a second direction which is perpendicular to the first one. These spherical rollers convey the folded sheet in the first direction to a pair of belts which improves the fold of the sheet of paper.

FR-A-2461671 discloses a folder comprising rotating folding knives by means of which a sheet material is first prefolded at right angles to its direction of transport, whereby the prefolded sheet is engaged by pairs of clamping rollers which rotate at an oblique angle to the feed direction and is then drawn away by the rotating folding knives. Also the pairs of clamping rollers permit only a very brief pressing together of the fold at the location of their points of contact. The movement of the material to be folded is here again deflected from a horizontal direction to a conveying direction that is directed downwards at an oblique angle so that also this type of folder is difficult to integrate in paper processing lines.

SUMMARY OF THE INVENTION

It is the object of the present invention to provide a knife folder used for folding a sheet material and permitting, on the basis of a reduced expenditure, a higher flexibility in the further processing of the folded sheet material.

This object is achieved by a A knife folder for folding a sheet material, comprising a sheet-material feed means for feeding the sheet material in a first direction; a folding device for folding said sheet material; and a sheet-material conveying means used for conveying the sheet material and comprising at least one pair of rotating conveying components whose axes of rotation are arranged in a second direction substantially at right angles to the first direction, the folding device pushing the folded sheet material between the conveying components of the at least one pair of conveying components when it is at its folding position, wherein the folding device comprises a knife extending in a third direction substantially at right angles to said first and said second direction; on the side facing the knife, the rotating conveying components have a reduced diameter in comparison with their maximum diameter; and the sheet material can be conveyed in the third direction by actuating the conveying components.

The present invention is based on the finding that, for obtaining a fold, it is only necessary that the sheet material is pressed together as long as possible in comparatively small areas bordering directly on the fold; in contrast to the prior art, it is not necessary that the areas located on both sides of the fold are engaged in their entirety, the fold itself being, however, pressed only very briefly.

According to the present invention it is also possible to avoid the necessity of changing the processing plane of the sheet material, since the direction of movement of the paper given by the knife folder according to the present invention does not correspond to the direction of movement of the folding knife, but is substantially perpendicular thereto. Rerouting devices and the like are therefore not necessary for returning the sheet behind the knife folder into the processing plane in which it was supplied to said knife folder. Furthermore, according to one embodiment of the knife folder according to the present invention, the sheet-material stream is rerouted at right angles by means of the knife folder device alone, such rerouting being often advantageous for a paper processing line.

Since the knife folder according to the present invention causes the sheet material to leave said knife folder in an upright position and substantially at right angles to the direction of movement of the folding knife, the position of the sheet material in the paper processing line behind the knife folder is freely selectable by turning devices having a simple structural design.

BRIEF DESCRIPTION OF THE DRAWINGS

In the following, a preferred embodiment of the present invention will be described in more detail making reference to the drawings enclosed, in which.

DETAILED DESCRIPTION OF A PREFERRED EMBODIMENT

Figure 1:
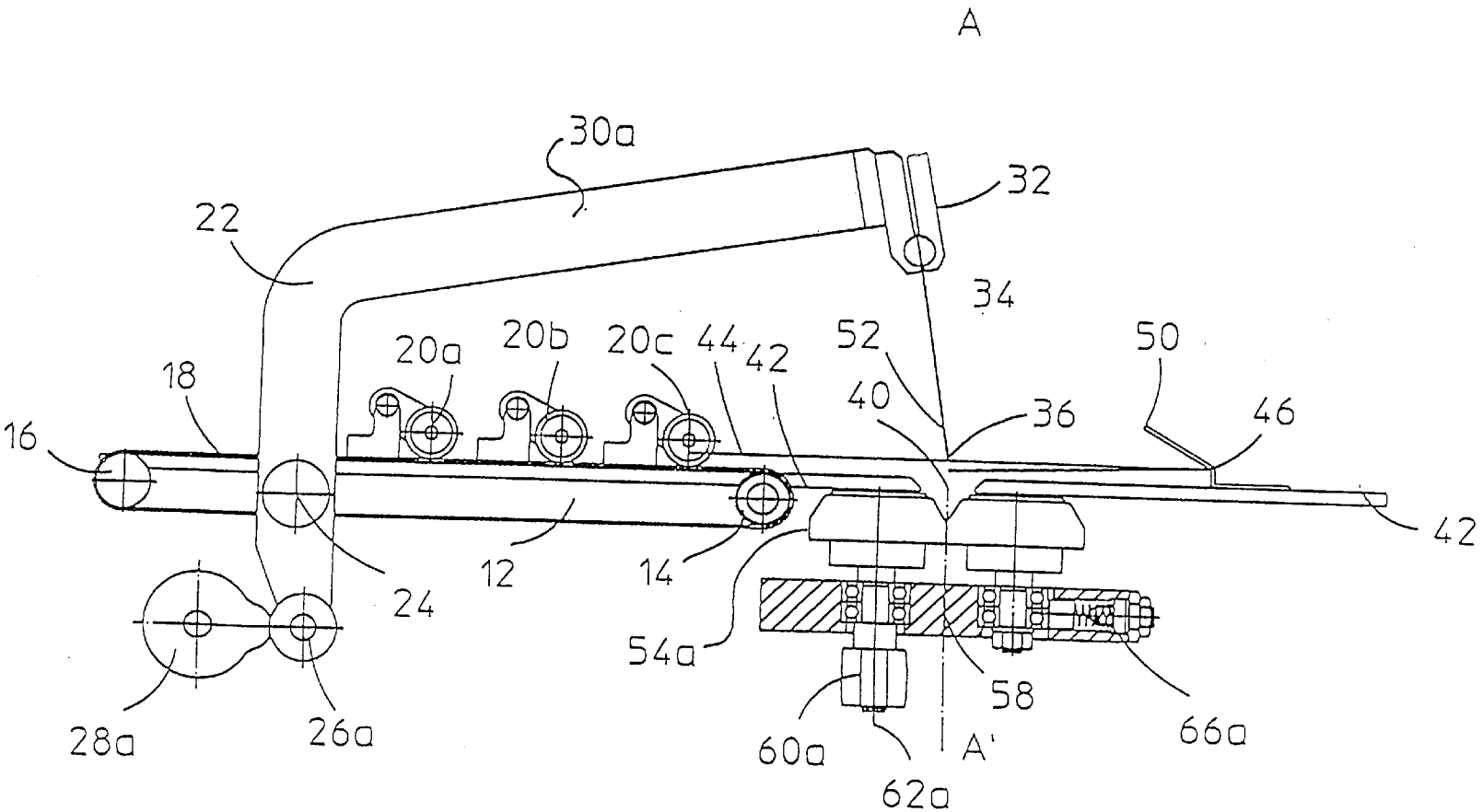
FIG. 1 shows a sectional side view of the knife folder according to the present invention, the folding knife being not at the folding position.
Figure 2:
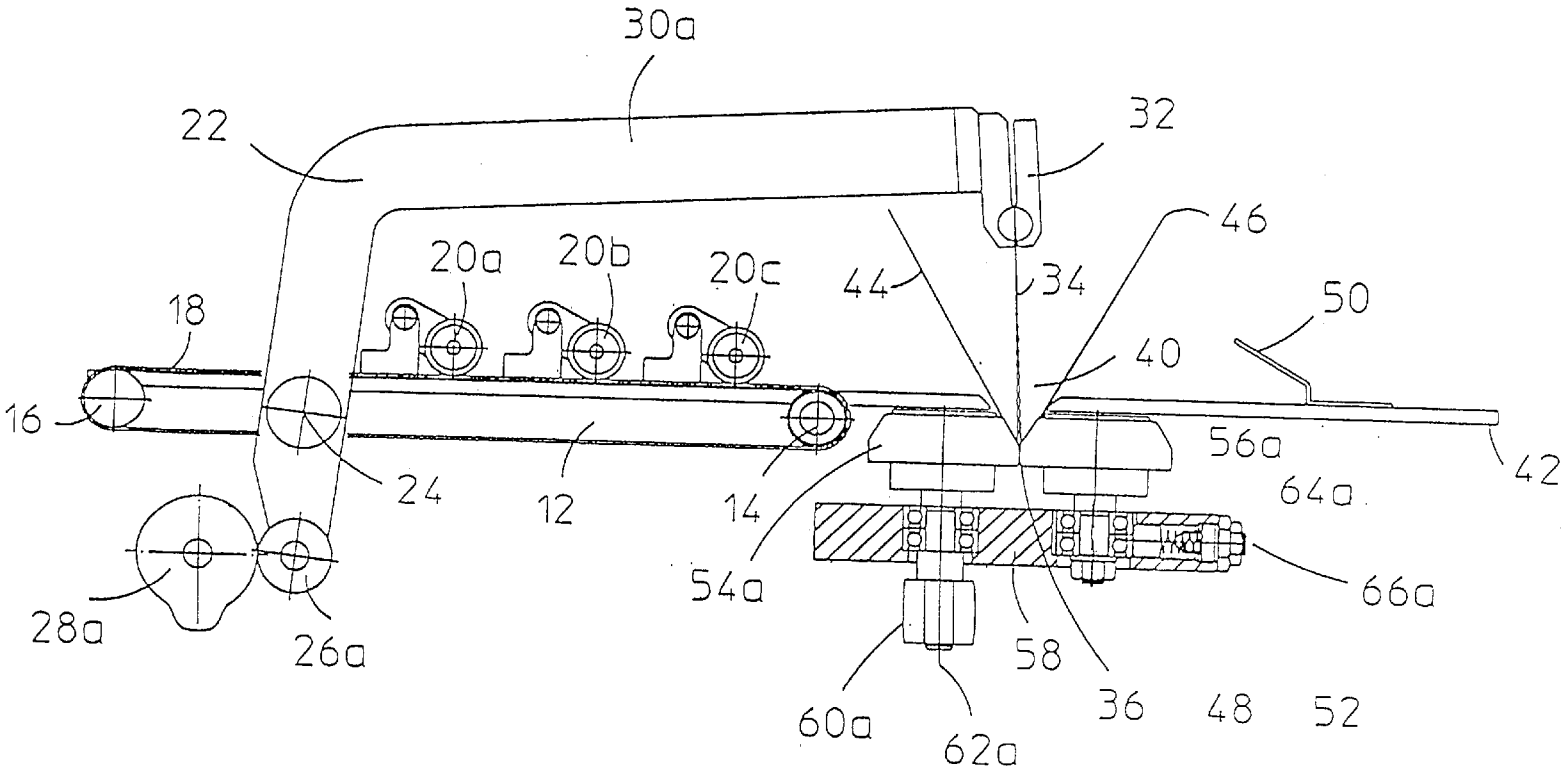
FIG. 2 shows a sectional side view of the knife folder according to the present invention, the folding knife being at the folding position.
Figure 3:
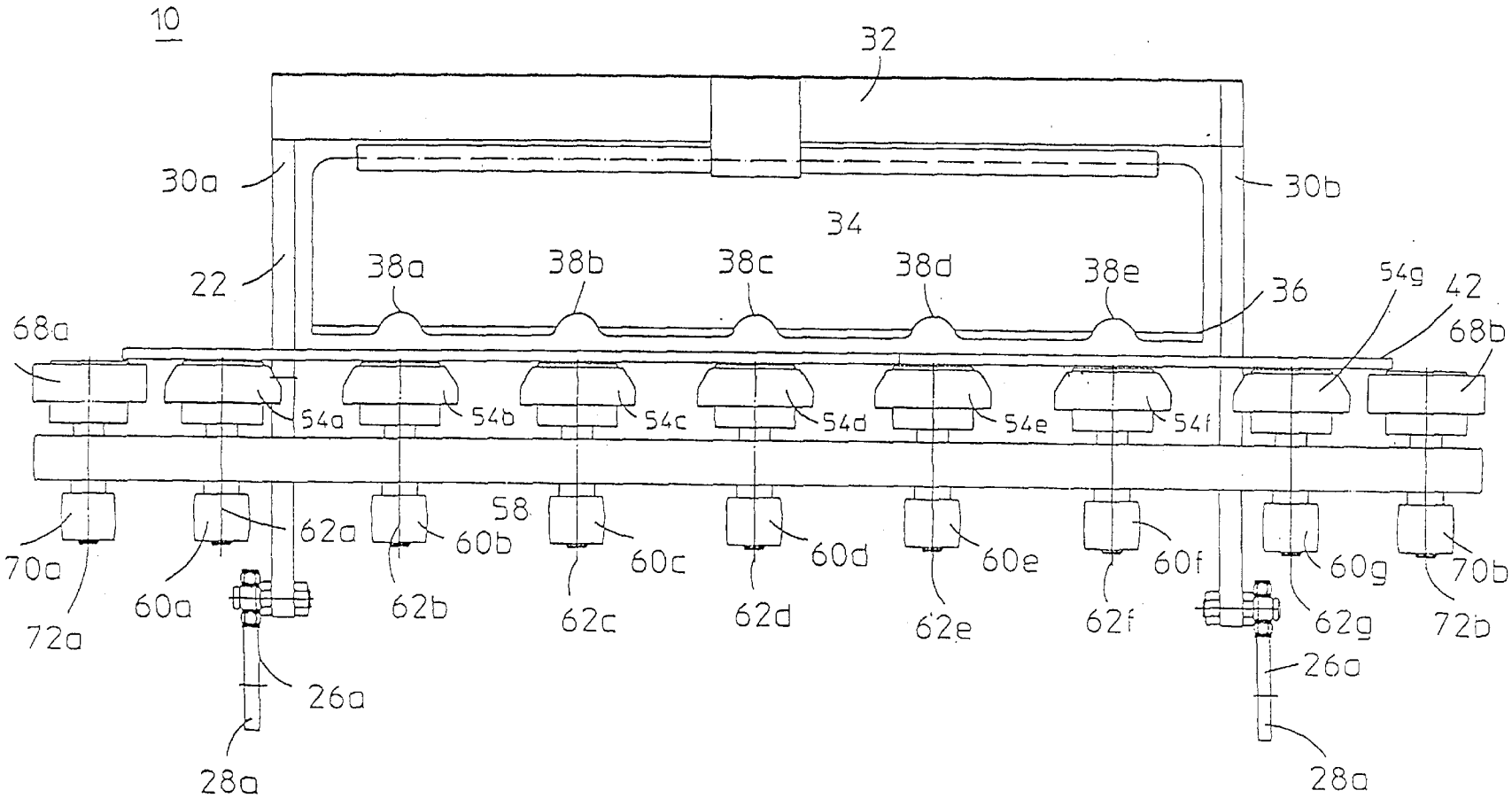
FIG. 3 shows a front view of the knife folder according to the present invention along line A–A' of FIG. 1.

FIG. 1, 2 and 3 show a knife folder 10. A feed means 12 comprises a drive cylinder 14, an idling cylinder 16, a transport belt 18 arranged between said drive cylinder 14 and said idling cylinder 16, and pressing cylinders 20*a*, 20*b*, 20*c*.

A lever arrangement 22 is secured to the feed means 12 such that it is adapted to be rotated about a lever tilting axis. The lever arrangement 22 is delimited by runners 26*a*, 26*b* on a side located opposite to the pressing cylinders 20 relative to the lever tilting axis 24, said runners being in engagement with respective cam discs 28*a*, 28*b*.

On a side of the lever arrangement 22 located opposite said combination of said cam discs 28*a*, 28*b* and said runners 26*a*, 26*b* relative to the lever tilting axis 24, lever arms 30*a*, 30*b* are formed, which are fixedly interconnected by means of a folding knife holder 32.

Furthermore, a folding knife 34 is connected to the folding knife holder 32. On the side of the folding knife 34 located opposite the folding knife holder 32 a folding edge 36 is formed. The folding knife 34 is provided with recesses 38*a*, 38*b*, 38*c*, 38*d*, 38*e* on the side of said folding edge 36, said recesses being uniformly spaced in the longitudinal direction of the folding knife 34, which is also referred to as knife direction.

Below the folding knife 34 there is a folding area 40 which is defined by a recess in the support 42 for a sheet material 44 to be folded. The sheet material 44 can be non-folded or it may e.g. already have a first fold 46. The position of a second fold 48 (FIG. 2) on said sheet material 44, which is produced by the knife folder 10 according to the present invention, is determined by the distance between a stop 50 and a contact line 52 of the folding edge 36 and the sheet material 44, said stop 50 being attached to the support 42 such that it is horizontally displaceable relative thereto according to the embodiment described.

According to the preferred embodiment, a plurality of transport rollers 54*a*–54*g* and a plurality of pressing rollers are provided on the side of the support 42 located opposite the sheet material 44. The respective transport rollers 54*a*–54*g* and the respective pressing rollers 56*a*–56*g* are rotatably supported in a roller support means 58. Transport roller drive means 60*a*–60*g* are arranged for rotating each of the transport rollers 54*a*–54*g* about respective axes of transport roller rotation 62*a*–62*g*. The pressing rollers 56*a*–56*g* are supported such that they are each rotatable about respective axes of pressing roller rotation 64*a*–64*g* relative to said transport rollers 54*a*–54*g*. In accordance with the preferred embodiment of the present invention, the axes of transport roller rotation 62*a*–62*g* and the axes of pressing roller rotation 64*a*–64*g* extend all parallel to one another and at right angles to the roller support means 58 as well as to the support 42. Respective opposed transport rollers 54*a*–54*g* and pressing rollers 56*a*–56*g* define a pair of conveying rollers, each pressing roller 56*a*–56*g* being pressed onto the associated transport roller 54*a*–54*g* of the pair of conveying rollers by a pressing device 66*a* comprising a spring in accordance with the present embodiment. Each pressing roller of each pair of conveying rollers can therefore be displaced at right angles to its respective axis of rotation.

In the case of the embodiment described, the transport rollers 54*a*–54*g* and the pressing rollers 56*a*–56*g* each have approximately the shape of a truncated cone. As can be seen from FIG. 1 and FIG. 2, the rollers are composed of a cylindrical base which tapers conically towards the folding knife. This conical taper continues at the respective edges of the recess in the support 42. This results in a V-shaped profile of the folding area 40. In other words, this V-shaped profile of the folding area 40 is defined by the cooperation of a pair of conveying rollers, said V-shaped profile being continued by the recess in said support 42.

As can be seen in FIG. 3, the recesses 38*a*–38*e*, which are provided in the folding knife 34, are each centered relative to the axes of transport roller rotation 62*b*–62*g* in the knife direction. Cylindrical pressure rollers 68*a*, 68*b*, 68*c*, 68*d* (68*c*, 68*d* not shown) are arranged in pairs in side-by-side relation with the respective outermost pair of conveying rollers 54*a*, 56*a* and 54*g*, 56*g*. The way in which the cylindrical pressure rollers, which are arranged in pairs, are oriented relative to one another corresponds to the orientation of the pairs of conveying rollers. Each of the cylindrical pressure rollers 68*a*, 68*b* is rotated about a respective axis of rotation 72*a*, 72*b* of said cylindrical pressure rollers by a drive means 70*a*, 70*b* for said cylindrical pressure rollers. The cylindrical pressure rollers 68*c*, 68*d*, which are not shown, are pretensioned towards the respective cylindrical pressure rollers 68*a*, 68*b*.

In the following, the mode of operation of a preferred embodiment of the knife folder 10 according to the present invention will be explained in detail.

When the sheet material 44, which can be folded (e.g. the first fold 46) or non-folded, has been transported with the aid of the feed means 12 over the folding area 40 in such a way that said sheet material 44 is in contact with the stop 50, the folding operation takes place.

FIG. 1 shows the condition of a preferred embodiment of the knife folder 10 according to the present invention immediately before the folding operation begins. The lever arrangement 22 and the folding knife 34 connected thereto via the folding-knife holder 32 are located at their position of maximum deflection relative to the support 42. This maximum deflection is given by the size of a cam provided at a specific peripheral section of the cam discs 28*a*, 28*b*. A joint rotation of the cam discs 28*a*, 28*b* causes the runners 26*a*, 26*b* to rotate as well, in the opposite direction of rotation, and this has the effect that the fixedly connected lever arms 30, 30*b*, which are rotatably supported about the lever tilting axis 24, descend into the folding area 40. This has the effect that the folding edge 36 of the folding knife 34 comes into contact with the sheet material 44 along the contact line 52. When the rotation of the cam discs 28*a*, 28*b* continues, the folding edge presses the sheet material deeper an deeper into the folding area, whereby the areas of the sheet material located outside of the folding area are raised to a V-shape, as can be seen from FIG. 2.

When the cam disc 28*a*, 28*b* rotates still further, the sheet will be pressed between the respective pairs of conveying rollers 54*a*–54*g*, 56*a*–56*g* by the folding knife 34, as can be seen in FIG. 2. The recesses 38*a*–38*e* prevent the folding knife 34 from being engaged by the pairs of conveying rollers at this position, which is referred to as folding position. The areas of the folding edge 36 located between said recesses 38*a*–38*e* cause the paper to be pressed between the pairs of conveying rollers against the biasing force exerted by the respective pressing devices (not shown). The sheet material 44 to be folded is now fixedly engaged by the individual pairs of conveying rollers due to the biasing force exerted by the individual pressing devices. Hence, the lever arrangement 22 can be raised again without disengaging the sheet material from the pair of conveying rollers. The folding knife 34 is thus removed from the folding area 40, whereupon a new folding cycle can begin.

Depending on the direction of rotation of the transport roller drive means 60*a*–60*g*, the sheet material, which has been engaged by the pairs of conveying rollers and raised to a V-shape, can, in relation to FIG. 1, laterally be removed from the folding area in the direction of the cylindrical pressure roller 68*a* or in the direction of the cylindrical pressure roller 68*b*. Due to this lateral removal from the folding area 40, the second fold 48, which was so to speak only prepared at the contact lines of the individual transport rollers 54*a*–54*g* and the individual pressing rollers 56*a*–56*g* at the moment at which the folding knife 34 was removed from the folding area 40, is fully executed by the individual pairs of conveying rollers. For improving the quality of the now fully executed second fold 48 still further, the sheet runs through the pair of cylindrical pressure rollers 68*a*, 68*b*, which is arranged on the side at which the folded sheet material 44 is transported away from the folding area.

For further processing the folded sheet material 44 in a paper processing line—the knife folder 10 according to the present invention being part of such a paper processing line—it turns out to be advantageous that the sheet occupies a raised, substantially vertical position, whereby said sheet can be laid, with the aid of simple means, on its first e.g. printed side or on its second e.g. non-printed side, as demanded by subsequent sheet material processing.

Summarizing, it can be stated that the knife folder 10 according to the present invention carries out in a single device not only the folding function but also the deflection at right angles and the raising of the sheet material.

Deviating from the embodiment shown, a plurality of different modifications of the knife folder 10 according to the present invention exists.

It is, for example, possible to omit the feed means 12, since the sheet material 44 can be fed directly into the knife folder 10 by a device preceding the knife folder 10 in the paper processing line. In this case, it will be necessary to fix the lever arrangement 22 in some other way and to synchronize it with the sheet material feed rate.

Furthermore, it is not necessary that the knife folder is oriented essentially horizontally. It can, for example, also be inclined in a certain manner, in accordance with the requirements of a specific case of use.

The folding knife 34 need not be suspended from the lever arrangement 22, but it can be suspended in some other way independently of the feed means 12 and it can hit the sheet material 44 at an arbitrary angle which is not parallel to said sheet material. In addition, it is of secondary importance to the present invention whether the recesses extend from the folding edge 36 to the folding knife holder 32, or whether they are not provided at all, as long as the surfaces of the transport rollers 54*a*–54*g* or of the pressing rollers 56*a*–56*g* are of such a nature that the sheet material 44 remains in engagement with the pair of conveying rollers when the folding knife 34 is moved away from the folding area 40.

Although a plurality of pairs of conveying rollers is shown, one pair of conveying rollers in combination with cylindrical pressure rollers 68*a*, 68*b* will suffice to produce a continuous fold of the sheet material 44. It is also possible to omit the cylindrical pressure rollers 68*a*, 68*b* because the continuous fold is already produced by the pairs of conveying rollers. In addition, it is not necessary that the sheet material feed means is implemented in the form of pairs of conveying rollers, since it is also possible to provide a continuous, elastic conveyor belt whose surface, which comes into contact with the sheet material 44, can be implemented such that it remains in engagement with the sheet material 44 when the folding knife 34 is removed from the folding area 40. The described reduction of size of the diameter of the transport rollers 54*a*–54*g* and of the pressing rollers 56*a*–56*g* existing in the direction of the support 42 need not be linear, but the cross-section can also be spherical, parabolic or it can be reduced continuously in some other way.

Finally, neither the support 42 nor the stop 50, which have been described with regard to a preferred embodiment of the knife folder 10, are absolutely necessary, since the sheet material 44 can also be placed at a specific position directly above the pairs of conveying rollers by means of a defined kinetic energy which the sheet material received from the feed means.

What is claimed is:

1. A knife folder for folding a sheet material, said knife folder having the following features:

a sheet-material feed means for feeding said sheet material in a first direction;

a folding device for folding said sheet material; and a sheet-material conveying means used for conveying said folded sheet material and comprising at least one pair of rotating conveying components whose axes of rotation are arranged in a second direction substantially at right angles to said first direction, each rotating conveying component having two sides, one of said two sides facing said folding device and another of said two sides facing away from said folding device, said axis of rotation of each rotating conveying component extending between said two sides;

said folding device pushing said sheet material between said at least one pair of rotating conveying components when it is at its folding position to obtain said folded sheet material, the movement of said knife, when said knife pushes said sheet material between said rotating conveying components being in said second direction;

wherein said folding device comprises a knife having a folding edge extending along a third direction substantially at right angles to said first and said second directions, said third direction thus being substantially at right angles to said direction of movement of said knife, when said knife pushes said sheet material between said rotating conveying components;

wherein, on said side facing said knife, each rotating conveying component of said at least one pair of rotating conveying components has a reduced diameter in comparison with its maximum diameter; and wherein said folded sheet material can be conveyed in said third direction by actuating said rotating conveying components.

2. The knife folder according to claim 1, wherein said conveying components consist of a pair of conveying rollers whose roller axes are arranged in said second direction.

3. The knife folder according to claim 2, wherein a plurality of pairs of conveying rollers is provided, said pairs of conveying rollers being arranged in spaced relationship with one another in said third direction.

4. The knife folder according to claim 2, wherein said rollers of said pairs of conveying rollers are frusto-conical.

5. The knife folder according to claim 2, wherein said rollers of said pairs of conveying rollers taper towards said knife.

6. The knife folder according to claim 2, wherein one roller of each pair of conveying rollers is adapted to be driven and that the other roller is spring-loaded in the direction of said first roller.

7. The knife folder according to claim 2, wherein outside of a folding area of the knife folder device, a pair of cylindrical pressure rollers is provided, said pressure rollers arranged in spaced relationship with said pair of conveying rollers in said third direction.

8. The knife folder according to claim 1, wherein said sheet-material feed means has a recess through which said knife extends when said knife is at its folding position.

9. The knife folder according to claim 2, wherein said knife is provided with at least one recess which is located in a mutual contact area of said rollers of said pair of conveying rollers at said folding position of said knife folder device.

10. The knife folder according to claim 1, further comprising a stop up to which said sheet material is fed prior to being folded.

* * * * *